US007161312B2

(12) United States Patent
Blum

(10) Patent No.: US 7,161,312 B2
(45) Date of Patent: Jan. 9, 2007

(54) DISTRIBUTED FLUORESCENT LIGHT CONTROL SYSTEM

(75) Inventor: Dieter Wolfgang Blum, Aldergrove (CA)

(73) Assignee: Sluggo Lighting Ltd., Aldergrove (CA)

( * ) Notice: Subject to any disclaimer, the term of this patent is extended or adjusted under 35 U.S.C. 154(b) by 96 days.

(21) Appl. No.: 10/917,358

(22) Filed: Aug. 13, 2004

(65) Prior Publication Data

US 2005/0035730 A1 Feb. 17, 2005

Related U.S. Application Data

(60) Provisional application No. 60/494,812, filed on Aug. 14, 2003.

(51) Int. Cl.
*H05B 37/00* (2006.01)

(52) U.S. Cl. ..... 315/312; 315/291; 315/246; 315/276; 315/DIG. 5

(58) Field of Classification Search ..... 315/312, 315/291, 246, 255, 276–279, DIG. 5, DIG. 7, 315/224
See application file for complete search history.

(56) References Cited

U.S. PATENT DOCUMENTS 5,479,326 A * 12/1995 Nilssen ..... 315/DIG. 2
5,483,127 A * 1/1996 Widmayer et al. ..... 315/307
5,485,057 A * 1/1996 Smallwood et al. ..... 315/58
6,724,152 B1 * 4/2004 Nostwick ..... 315/291
6,750,619 B1 * 6/2004 Nemirow et al. ..... 315/291

* cited by examiner

*Primary Examiner*—Wilson Lee
*Assistant Examiner*—Ephrem Alemu
(74) *Attorney, Agent, or Firm*—Oyen Wiggs Green & Mutala LLP

(57) ABSTRACT

Systems and methods are provided for operating a fluorescent tube having a pair of filaments. The system comprises a transformer, an AC signal generator and a coupling device. The AC signal generator is connected to drive a primary AC signal onto the primary winding of the transformer and to thereby create a secondary AC signal on the secondary winding of the transformer. The secondary winding of the transformer is coupled between the filaments of the fluorescent tube at first terminals thereof. The coupling device is coupled between the filaments at second terminals thereof. The coupling device is switchable between a conducting state, wherein a majority of the current associated with the secondary AC signal is conducted by the coupling device, and a non-conducting state wherein a voltage drop across the coupling device is sufficient to cause a majority of the current associated with the secondary AC signal to arc between the filaments of the fluorescent tube.

24 Claims, 6 Drawing Sheets

DISTRIBUTED FLUORESCENT LIGHT CONTROL SYSTEM

RELATED APPLICATIONS

This Application claims the benefit of the priority date of U.S. application No. 60/494,812 Aug. 14, 2003 under 35 USC § 119(e).

TECHNICAL FIELD

The invention relates to fluorescent lighting. Particular embodiments of the invention comprise systems for controlling one or more fluorescent light tubes.

BACKGROUND OF THE INVENTION

Fluorescent lights are well known in the lighting industry as efficient light sources. Fluorescent lights have a wide variety of domestic and industrial applications, including lighting rooms, lighting workspaces and lighting signs, for example. In general, fluorescent lights comprise one or more fluorescent tubes, each tube providing a separate light source. Fluorescent tubes can vary in size, with larger tubes generally drawing more power and providing more light.

As is well known in the art, fluorescent tubes are a gas discharge type of light source. A typical prior art fluorescent tube 10 is shown schematically in FIG. 1, along with its ballast 12, its power supply 14 and its starter switch 20. Ballast 12 conventionally comprises at least one ferromagnetic inductor 13. Fluorescent tube 10 comprises a pair of filaments 16, 18 which typically have some slight resistance on the order of approximately 0.5–30 Ω. Tube 10 also contains a small amount of mercury (initially a liquid) and one or more inert gases, such as argon, which are under low pressure.

Lighting tube 10 involves creating current flow or "arc" through tube 10 between filaments 16, 18. In fluorescent tubes commonly referred to as the "hot cathode" type, creating the current in tube 10 typically involves preheating at least one of filaments 16, 18 to cause thermionic emission of electrons. Filaments 16, 18 may be coated with various types of materials well known in the art to increase the amount of thermionic emission. Preheating filaments 16, 18 may be said to "boil off" electrons. In addition to preheating filaments 16, 18, creating a current arc through tube 10 also typically involves providing a relatively large "ignition voltage" across tube 10. The ignition voltage induces ionization of the inert gas in tube 10 and ignites the current flow between filaments 16, 18. The required ignition voltage for a given tube 10 varies depending on many factors. Typical commercial fluorescent tubes of the hot cathode type operate with an ignition voltage in a range between 300–800 V AC RMS. The thermionic emission of electrons into tube 10 during preheating of filaments 16, 18 tends to reduce the required ignition voltage. Typically, the ignition voltage is provided between filaments 16, 18 by ballast 12, which works together with starter switch 20 as explained briefly below.

During preheating, starter switch 20 is closed and AC current flows through inductive ballast 12, filament 16, switch 20 and filament 18. This current preheats filaments 16, 18, resulting in thermionic emission of electrons, and also builds up a magnetic field in the inductor 13 of ballast 12. During preheating, there may also be some ionization of the gas in tube 10; however, the voltage across tube 10 (i.e. between filaments 16, 18) is not sufficient to create a current arc through the gas in tube 10. Consequently, almost all of the current flows through starter switch 20 and correspondingly little or no current flows through tube 10.

When a sufficient number of electrons have been thermionically emitted from filaments 16, 18 and sufficient magnetic field has been established in inductor 13 of ballast 12, starter switch 20 is opened, briefly cutting off current flow through ballast 12. When the current is cut off from ballast 12, the magnetic field in the inductor 13 of ballast 12 collapses, causing an inductive voltage spike. This inductive voltage spike provides the ignition voltage across tube 10 (i.e. between filaments 16, 18), which in turn ionizes the gas in tube 10 and creates an arc of current between filaments 16, 18.

Instead of flowing through starter switch 20, current now flows through tube 10. Current flow is maintained through tube 10 by electrons emitted from hot filaments 16, 18 and by the electrons and ionized gas particles in tube 10. Filaments 16, 18 remain hot because of the emission of electrons. These moving ions and electrons provide energy to the mercury contained in tube 10, converting some of the mercury from liquid to gas. Collisions between electrons and gaseous mercury atoms cause electrons in the gaseous mercury atoms to occupy higher energy states. When these mercury electrons return to their ground energy states, they release ultra-violet photons. Tube 10 is typically coated with phosphors (not shown), which absorb the ultraviolet photons. Absorption of ultraviolet photons causes the electrons of the phosphors to occupy higher energy states. When these phosphor electrons return to their ground energy states, they release photons in the visible spectrum.

When the arc is created through tube 10, the resistance between filament 16 and filament 18 decreases. More specifically, the flow of electrons and ions through tube 10 creates collisions with other atoms, liberating more ions and electrons and facilitating the flow of more current. Inductive ballast 12 prevents damage to filaments 16, 18 and tube 10 by limiting the total current through tube 10. Since power supply 14 typically provides a known AC signal, the inductance of inductor 13 of ballast 12 may be selected appropriately to limit the current through tube 10 to a desired level.

More recently designed fluorescent tubes, known as "rapid start" tubes, incorporate the same basic principles as the classical tubes described above. Other modern fluorescent tubes, known as "instant start" tubes, eliminate the preheating stage and ignite current flow through the tube with a corona discharge. The corona discharge associated with instant start tubes causes stress on tube components, particularly the filaments, and reduces the service life of the tube. Still other types of fluorescent tubes, known as "cold cathode" tubes incorporate relatively large, typically iron, electrodes. Cold cathode tubes require extremely large voltage drops between their electrodes to generate electrons through the impact of accelerated ions, which is referred to as "secondary emission". These large voltages are a safety concern, particularly in multi-tube applications. Modern fluorescent tubes may also utilize more complex solid state electronic ballasts, which use high frequency switching techniques to provide ignition voltage and current regulation in a manner similar to classical inductive ballasts.

For some applications, such as industrial signage for example, there remains a general need for low cost control systems capable of independently controlling a plurality of fluorescent tubes. Because the ignition voltages of fluorescent tubes can be quite high, it is desirable to generate such voltages in close proximity to the tubes, and to thereby minimize the required voltage(s) on exposed wiring connections.

SUMMARY OF INVENTION

One aspect of the invention provides a system for controlling a light having a plurality of fluorescent tubes. The system comprises a plurality of transformers located in the light. Each transformer has a primary winding and a secondary winding coupled between the filaments of a corresponding one of the fluorescent tubes at first terminals thereof. The system also comprises a plurality of sensors. Each sensor is connected to detect signal information indicative of a signal between the filaments of a corresponding one of the fluorescent tubes. One or more AC signal generators are located remotely from the light. The one or more AC signal generators are capable of generating a plurality of low voltage AC signals. Each low voltage AC signal is associated with a corresponding one of the fluorescent tubes. The system also comprises a plurality of low voltage AC links. Each low voltage AC link is connected to conduct a corresponding low voltage AC signal between the one or more AC signal generators and the primary winding of a corresponding transformer of a corresponding one of the fluorescent tubes. A controller is located remotely from the light and is connected to receive signal information from the plurality of sensors. The controller configured, on the basis of the signal information, to independently control one or more characteristics of each of the low voltage AC signals.

The system may also comprise a plurality of coupling devices located in the light. Each coupling device may be associated with a corresponding one of the fluorescent tubes and may be coupled between the filaments of the corresponding fluorescent tube at second terminals thereof. Each coupling device may be changeable between a conducting state, wherein the coupling device is capable of conducting sufficient current to prevent arcing between the filaments of the corresponding fluorescent tube, and a non-conducting state wherein a voltage drop across the coupling device is sufficient to cause current to arc between the filaments of the corresponding fluorescent tube. Each coupling device may comprise a capacitor to form an LCR resonant circuit with the secondary winding of its corresponding transformer and the filaments of its corresponding fluorescent tube.

Each signal sensor may be connected to sense signal information relating to the low voltage signal associated with the corresponding fluorescent tube at a location remote from the light. For each signal sensor, the controller may be configured to estimate signal information related to the signal between the filaments of the corresponding fluorescent tube. The only electrical connections necessary to independently control operation of the plurality of fluorescent tubes may be the plurality of low voltage AC links.

Each signal sensor may be located in the light and may be connected to sense signal information relating to a secondary AC signal in the secondary winding of the corresponding transformer. The controller may be configured to estimate signal information related to the signal between the filaments of the corresponding fluorescent tube. The only connections necessary to independently control operation of the plurality of fluorescent tubes may be the plurality of low voltage AC links and a communication link for providing signal information from the sensors to the controller.

The controller may be configured to independently control operation of the plurality of fluorescent tubes using time division multiplexing.

Another aspect of the invention provides a system for controlling a light having a plurality of fluorescent tubes. The system comprises a plurality of transformers located in the light. Each transformer has a primary winding and a secondary winding coupled between the filaments of a corresponding one of the fluorescent tubes at first terminals thereof. The system also comprises a plurality of sensors located in the light. Each sensor is connected to detect signal information related to a signal between the filaments of a corresponding one of the fluorescent tubes. One or more AC signal generators are located in the light. The one or more AC signal generators are capable of generating a plurality of low voltage AC signals and driving a corresponding one of the low voltage AC signals onto the primary winding of a corresponding transformer of a corresponding one of the fluorescent tubes. A low voltage DC link provides a low voltage DC signal to the one or more AC signal generators. The system also comprises a controller located remotely from the light. The controller is connected to receive signal information from the plurality of sensors over a communication link. The controller is configured, on the basis of the signal information, to generate control signals and to communicate the control signals to the one or more AC signal generators over the communications link so as to independently control one or more characteristics of each of the low voltage AC signals.

Another aspect of the invention provides a method for controlling a light having a plurality of fluorescent tubes. A plurality of transformers located in the light are provided. Each transformer has a primary winding and a secondary winding coupled between the filaments of a corresponding one of the fluorescent tubes at first terminals thereof. A plurality of capacitors are provided. The capacitors are located in the light and each capacitor is coupled between the filaments of a corresponding one of the fluorescent tubes at second terminals thereof. The secondary winding, the capacitor and the filaments of each fluorescent tube form an LCR resonant circuit. The method comprises generating a plurality of low voltage AC signals having a relatively high frequency at a location remote from the light; conducting the plurality of low voltage AC signals to the light over a corresponding plurality of low voltage AC links; and applying each low voltage AC signal to the primary winding of a corresponding transformer of a corresponding one of the fluorescent tubes. The emthod also comprises decreasing a frequency of the plurality of low voltage AC signals until resonance in the corresponding LCR circuits causes the corresponding fluorescent tubes to ignite.

Further features of specific embodiments of the invention, aspects of the invention and applications of the invention are described below.

BRIEF DESCRIPTION OF DRAWINGS

In drawings which illustrate non-limiting embodiment of the invention.

DETAILED DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 2:
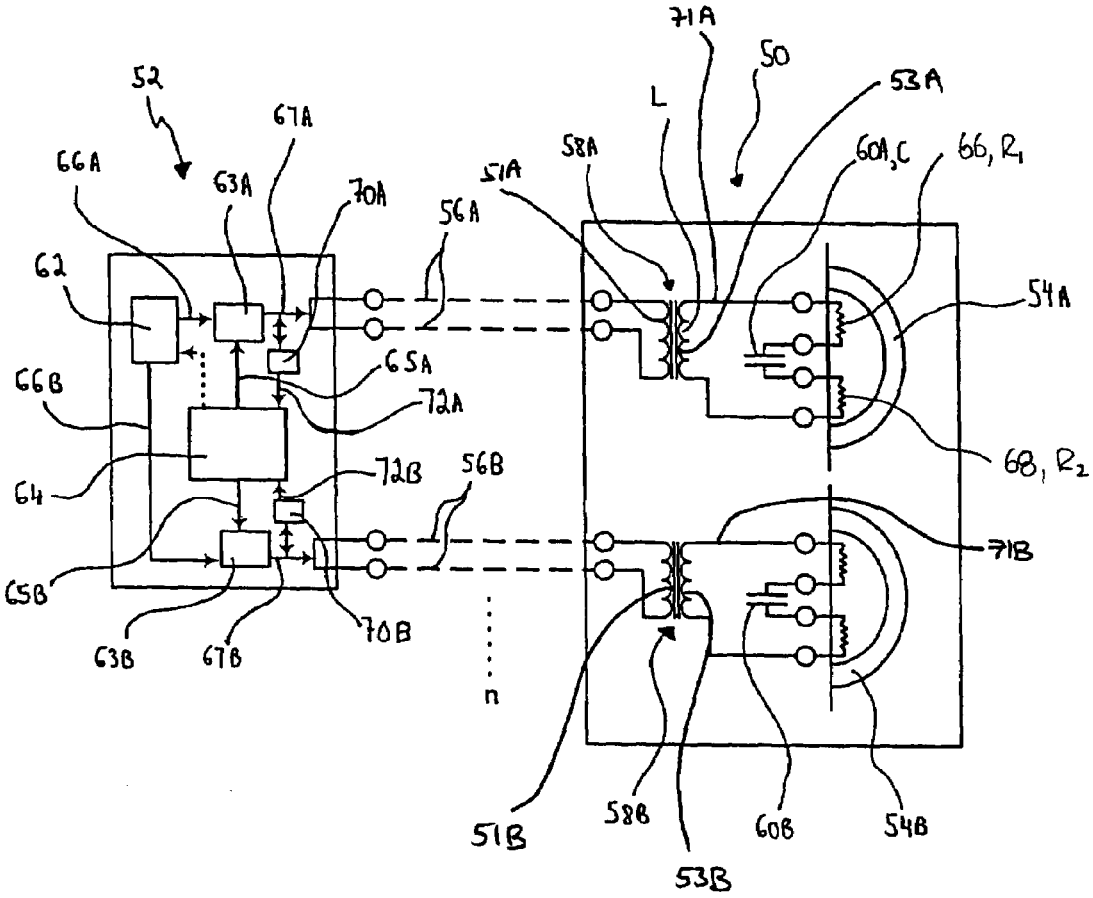
FIG. 2 is a schematic diagram of a fluorescent light, together with a distributed light controller according to a particular embodiment of the invention.

FIG. 2 schematically depicts a multi-tube fluorescent light 50, which comprises a distributed lighting control system 52 according to a particular embodiment of the invention. For clarity, light 50 is shown in FIG. 2 to have only two fluorescent tubes 54A, 54B, it being understood that light 50 may generally include any practical number of tubes 54. In addition, tubes 54 in light 50 may have different sizes, shapes, intensities and/or operating characteristics. Control system 52 may be located at a remote location, away from light 50. In the illustrated embodiment, control system 52 is independently connected to each tube 54A, 54B of light 50 by a corresponding low voltage AC link 56A, 56B. In this description and the accompanying claims, the terms "low voltage AC link", "low voltage AC connector" and similar terms are understood to mean an electrical connection rated to carry a maximum of 60V AC RMS and the term "low voltage AC signal" and similar terms are understood to mean an AC electrical signal having a voltage of less than or equal to 60V AC RMS. In preferred embodiments, the low voltage AC links and low voltage AC connectors of all of the systems described herein are rated to carry a maximum of 30 V AC RMS and the low voltage AC signals used by such systems have a voltage less than or equal to 30 V AC RMS. These connections and signals allow users to avoid the need for licensed electricians in order to install the systems of the invention.

In alternative embodiments explained in more detail below, control system 52 is also connected to light 50 by one or more communications links. Such communications links may be provided using wireless components and may carry information related to the control of light 50 by control system 52. In other alternative embodiments explained in more detail below, control system 52 is connected to light 50 by one or more low voltage DC links. In this description and the accompanying claims, the term "low voltage DC link" and similar terms are understood to mean an electrical connection rated to carry a maximum of 84.8V DC and the term "low voltage DC signal" and similar terms are understood to mean a DC electrical signal having a voltage of less than or equal to 84.8V DC. In preferred embodiments, the low voltage DC links and low voltage DC connectors of all of the systems described herein are rated to carry a maximum of 42.4V DC and the low voltage DC signals used by such systems have a voltage less than or equal to 42.4V DC. These connections and signals allow users to avoid the need for licensed electricians in order to install the systems of the invention.

Each fluorescent tube 54A, 54B comprises an associated transformer 58A, 58B and an associated capacitor 60A, 60B, which, as explained further below, provide the drive signal to their respective tubes 54A, 54B. As shown in FIG. 2, transformer 58A is connected between filaments 66, 68 of tube 54A at first terminals thereof. Capacitor 60A is connected between filaments 66, 68 at the other two terminals thereof. Transformer 58B and capacitor 60B are similarly connected to the terminals of tube 54B.

In the FIG. 2 embodiment, transformers 58A, 58B and capacitors 60A, 60B associated with each tube 54A, 54B represent the only components located within (or in close proximity to) light 50. In alternative embodiments, light 50 also includes control related components (e.g. sensors and their associated circuitry), drive components and/or communications circuitry (i.e. for sending and receiving control signals from control system 52). As will be explained further below, the low voltage AC drive signals provided by control system 52 on low voltage AC links 56A, 56B are preferably in a range between 35–100 kHz. As such, transformers 58A, 58B may be made relatively small. Transformers 58A, 58B may be adjustable ferrite core transformers, which are suitable for this range of frequencies. The minimal circuitry located within (or in close proximity to) light 50 represents an advantage over prior art lights, which include cumbersome and expensive inductive and/or electronic ballasts, active drive circuitry, electronic controllers and communications circuitry.

Control system 52 includes a controller 64. Controller 64 may be embodied by a wide variety of components. For example, controller 64 may comprise one or more programmable processor(s) which may include, without limitation, embedded microprocessors, dedicated computers, groups of data processors or the like. Some functions of controller 64 may be implemented in software, while others may be implemented with specific hardware devices. The operation of controller 64 may be governed by appropriate firmware/code residing and executing therein, as is well known in the art. Controller 64 may comprise memory or have access to external memory (not shown).

Control system 52 also includes a DC power supply 62, which preferably outputs a DC signal between 15–90 V DC. DC power supply 62 may have a wide variety of embodiments, the particular form of which is not germane to the invention. For example, DC power supply 62 may be an off the shelf DC power supply which plugs into a wall outlet to convert AC power into a DC signal. Such a converter may be a switch mode power supply or a linear power supply. DC power supply 62 may comprise one or more batteries. DC power supply 62 may be controlled by controller 64. Alternatively, DC power supply 62 may be controlled directly by a user.

DC power supply 62 provides DC power signals 66A, 66B to low voltage AC signal generators 63A, 63B, which are respectively associated with low voltage AC links 56A, 56B of tubes 54A, 54B. AC signal generators 63A, 63B may comprise any type of well known AC signal generator, such as half-bridge generators, full-bridge generators, single transistor chopper generators, thyristor-based generators, inverters and the like. AC signal generators 63A, 63B receive DC signals 66A, 66B from DC power supply 62 and receive control inputs 65A, 65B from controller 64. In response to these inputs, AC signal generators 63A, 63B generate controllable primary AC signals 67A, 67B. Primary AC signals are low voltage AC signals which are provided to their associated low voltage AC links 56A, 56B. Using control inputs 65A, 65B, controller 64 can control AC signal generators 63A, 63B to independently adjust various characteristics of their respective primary AC signals 67A, 67B.

Adjustable characteristics of primary AC signals 67A, 67B may include: the average value, RMS value, amplitude, waveform shape, frequency and/or duty cycle of the voltage and/or current associated with primary AC signals 67A, 67B.

Preferably, signal generators 63A, 63B generate primary AC signals 67A, 67B which are substantially sinusoidal in shape. However, primary AC signals 67A, 67B may vary in shape and may be square waves or saw tooth waves, for example. The waveform shape of primary AC signals 67A, 67B may be controlled by controller 64. In general, the exact waveform shape of primary AC signals 67A, 67B (and the waveform shape of the signals across tubes 54A, 54B) will depend on the complex impedance of the load "seen" by these signals.

In alternative embodiments, some aspects of DC power supply 62 and AC signal generators 63A, 63B are combined. For example, control system 52 may include a combined DC power supply and AC signal generator for each fluorescent tube 54A, 54B. Alternatively, a single power unit may receive power from an external source and may provide a plurality of controllable low voltage AC signal outputs, with one such low voltage AC signal output corresponding to each fluorescent tube 54A, 54B. In yet another alternative embodiment, AC signal generators 63A, 63B may be combined into a single AC signal generator which receives DC power from a DC supply 62 and which provides a controllable low voltage AC signal for each fluorescent tube 54A, 54B.

In the illustrated embodiment of FIG. 2, control system 52 also comprises signal sensors 70A, 70B, which are respectively associated with AC signal generators 63A, 63B and primary AC signals 67A, 67B. Signal sensors 70A, 70B may sense one or more characteristics of their associated primary AC signals 67A, 67B and feed this signal information 72A, 72B back to controller 64. In alternative embodiments explained in more detail below, signal sensors 70A, 70B are located in light 50 and are connected to sense one or more characteristics of secondary AC signals 71A, 71B on the secondary windings 53A, 53B of transformers 58A, 58B.

Those skilled in the art will appreciate that the measured characteristics of low voltage primary AC signals 67A, 67B are related to characteristics of corresponding high voltage signals through the terminals of fluorescent tubes 54A, 54B. Controller 64 may use measured signal information 72A, 72B to estimate characteristics of the high voltage signals through the terminals of fluorescent tubes 54A, 54B and to determine suitable control signals 65A, 65B for adjustment of low voltage primary AC signals 67A, 67B. Signal information 72A, 72B may comprise information about the average value, RMS value, amplitude, waveform shape, frequency and/or duty cycle of the voltage and/or current of primary AC signals 67A, 67B. Preferably, signal sensors 70A, 70B have current sensing capabilities and signal information 72A, 72B includes information related to the current of signals 67A, 67B, which in turn is related to the current through the terminals of fluorescent tubes 54A, 54B.

Figure 6:
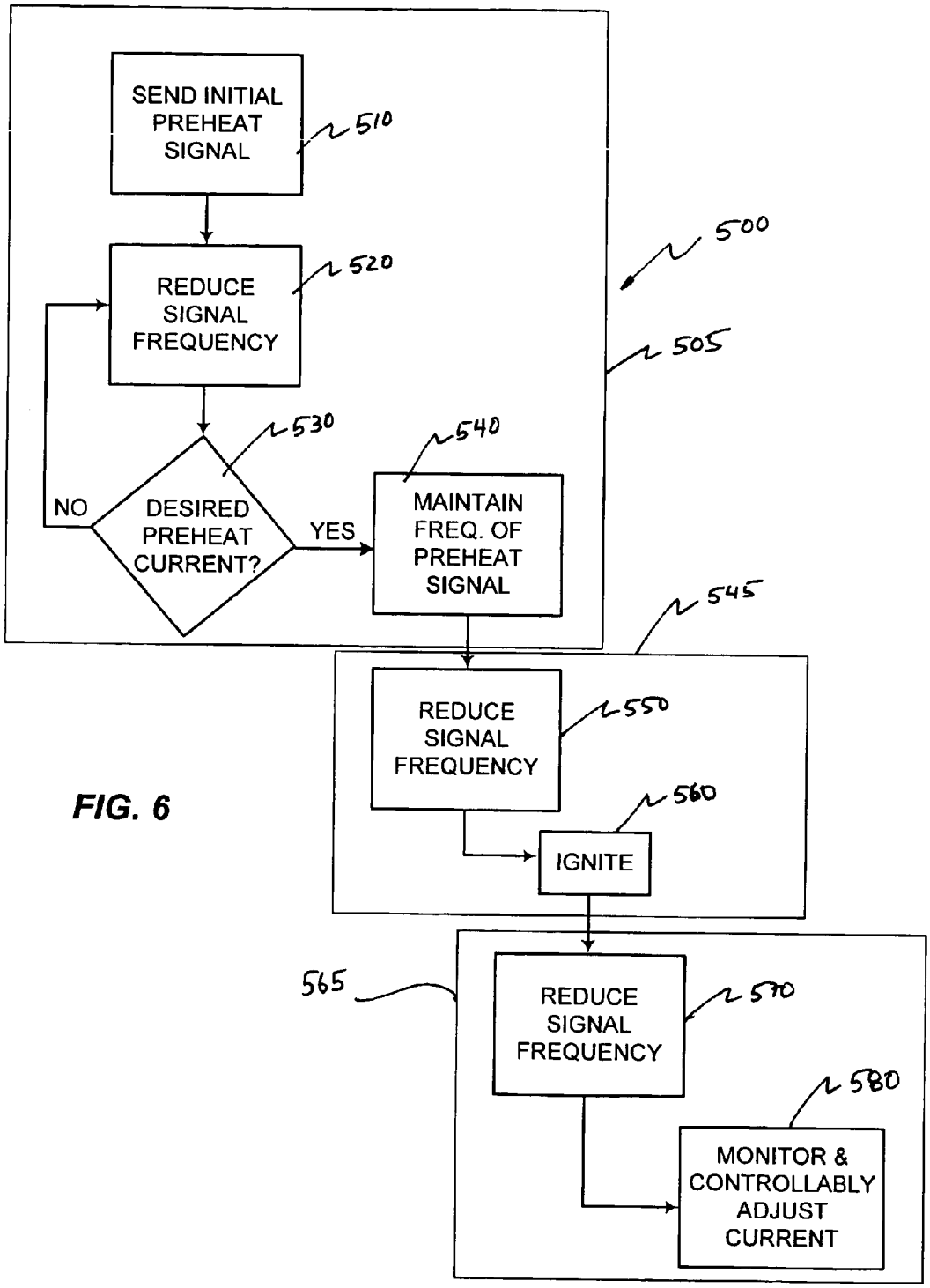
FIG. 6 is a schematic block diagram of a method of preheating, igniting and controlling a fluorescent tube in accordance with a particular embodiment of the present invention

The operation of control system 52 and light 50 is now explained with reference to FIG. 6. It is assumed, for the purposes of this explanation, that control system 52 has received an indication that it is desired to light a particular fluorescent tube 54A. FIG. 6 schematically depicts a method 500 of preheating, lighting and controlling a particular fluorescent tube 54A within light 50.

The preheat phase is represented in FIG. 6 by reference numeral 505. As described above, DC power supply 62 provides DC signal 66A to AC signal generator 63A. DC signal 66A is preferably in a range between 15–90 V. DC power supply 66A may be controlled by a user or by controller 64. At the outset of preheat phase 505, in block 510, controller 64 supplies AC signal generator 63A with a control signal 65A, which causes AC signal generator 63A to output a low voltage primary AC signal 67A over low voltage AC link 56A. Initially, low voltage AC signal 67A has a relatively low frequency. Preferably, at the outset of preheat phase 505, primary AC signal 67A has a frequency in a range of 85–100 kHz.

Low voltage AC link 56A conducts primary AC signal 67A to sign 50, where primary AC signal is received on the primary winding 51A of transformer 58A. Transformer 58A steps up primary AC signal 67A to become a high voltage secondary AC signal 71A on the secondary winding 53A of transformer 58A. Advantageously, primary AC signal 67A is a low voltage AC signal and, because transformer 58A is located within (or in close proximity to) light 50, only low voltage AC connections are required between control system 52 and light 50. The use of low-voltage AC connections(and low voltage AC signals) between control system 52 and light 50 (i.e. the omission of high voltage connections) substantially increases the operational safety of light 50, particularly in applications where an electrical discharge may be of grave concern, such as in a petroleum refilling station for example.

Figure 3:
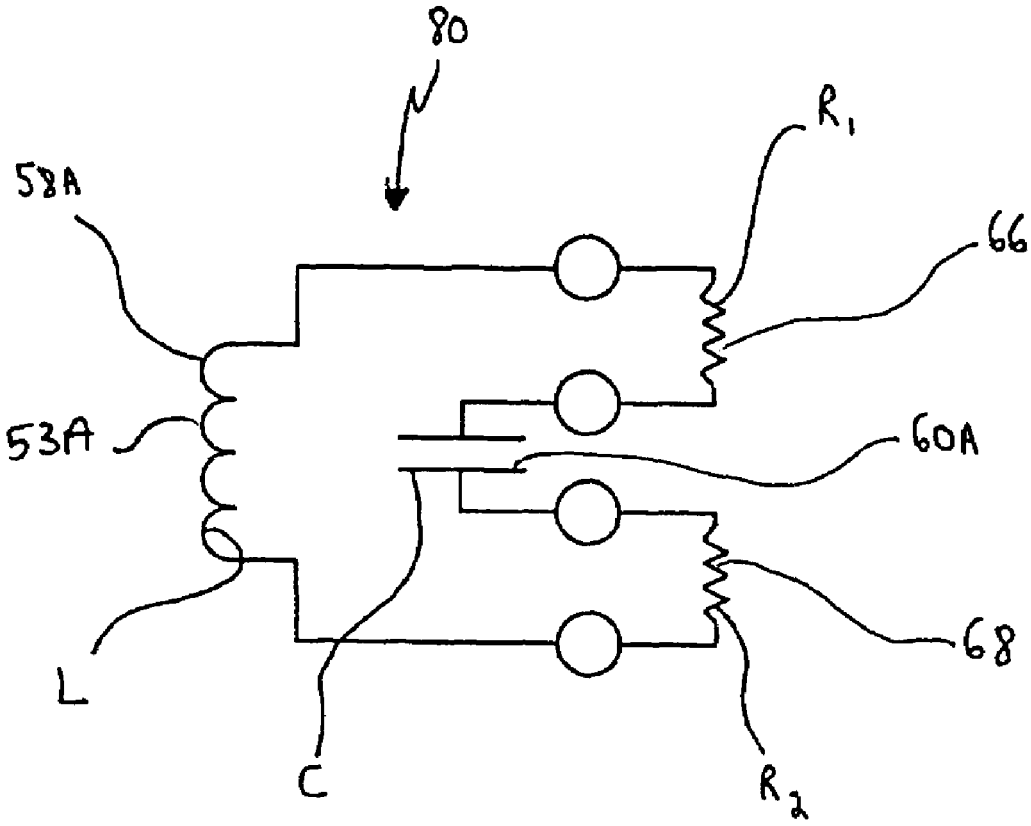
FIG. 3 is a schematic circuit diagram of the LCR circuit associated with a fluorescent tube of the FIG. 2 light.

The inductance L of the secondary winding 53A of transformer 58A, the resistances R1, R2 of filaments 66, 68 and the capacitance C of capacitor 60A form an LCR circuit 80, best seen in FIG. 3. The capacitance C of capacitor 60A and the inductance L of secondary winding 53A are selected, such that during block 510 (FIG. 6), the initial preheat phase low voltage primary AC signal 67A and high voltage secondary AC signal 71A are in a frequency range that is well above the resonant frequency of LCR circuit 80. This selection of capacitor 60A and transformer 58A ensures that at the outset of preheat phase 505, secondary AC signal 71A signal creates a relatively small current flow through transformer 58A, filaments 66, 68 and capacitor 60A. In alternative embodiments, transformer 58A and capacitor 60A may be adjustable, such that capacitance C of capacitor 60A and the inductance L of secondary winding 53A may be adjusted to provide the characteristics described above.

In block 520, controller 64 causes AC signal generator 63A to controllably reduce the frequency of primary AC signal 67A. As the frequency of primary AC signal 67A decreases, the frequency of secondary AC signal 71A also decreases and the current flow through LCR circuit 80 begins to increase. This increase in current flow is sensed by signal sensor 70A, which feeds this current information back to controller 64 as part of signal information 72A. Controller 64 continues to reduce the frequency of primary AC signal 67A until it determines (in block 530) that the current flow through LCR circuit 80 has reached a desired preheat current level (as measured by sensor 70A). The time required from start up until the desired preheat current level is reached may be on the order of 1–5 ms, for example.

In block 540, controller 64 causes signal generator 63A to maintain the frequency of primary AC signal 67A, such that the desired preheat current level through LCR circuit 80 is maintained for a desired preheat period. The frequency of primary AC signal 67A associated with the desired preheat current level may be in a range of 60–90 kHz. Controller 64 may stop reducing the frequency of primary AC signal 67A as soon as it determines (on the basis of signal information 72A obtained by sensor 70A) that the current flow through LCR circuit 80 has reached the desired preheat current level.

Alternatively, controller 64 may actively control the frequency of primary AC signal 67A such that the current flow through LCR circuit 80 tracks the desired preheat current level. The preheat period of block 540 may have a duration in a range of 100–500 ms, for example. During the preheat period of block 540, the desired preheat current flows through filaments 66, 68 causing filaments 66, 68 to heat up in an optimal and stress-free manner.

As discussed above, when filaments 66, 68 heat up to reach their thermionic emission temperature, which may be in the range of 800–2200 K, for example, electrons are thermionically emitted into tube 54A. At the end of preheat phase 505, a sufficient quantity of electrons has been emitted from filaments 66, 68 into tube 54A and tube 54A is ready for ignition. Because control system 52 is able to optimize the preheating of filaments 66, 68, the ignition of tube 54A is able to occur at a relatively low ignition voltage, with less stress on filaments 66, 68 and other parts of tube 54A.

As frequencies of low voltage primary AC signal 67A and high voltage secondary AC signal 71A decrease during preheat phase 505, the voltage drop across capacitor 60A tends to increase, which increases the potential difference across tube 54A (i.e. between filament 66 and filament 68). The capacitance C of capacitor 60A and the inductance L of transformer coil 58A are preferably selected, such that throughout preheat phase 505, the frequencies of low voltage primary AC signal 67A and high voltage secondary AC signal 71A are maintained above the resonant frequency of LCR circuit 80. In particular, the selection of capacitor 60A and transformer 58A ensures that during preheat phase 505, the current flow through transformer 58A, filaments 66, 68 and capacitor 60A is sufficient to preheat filaments 66, 68, but the voltage across tube 54A (i.e. between filament 66 and filament 68) is well below the voltage required to ignite an arc through tube 54A. In alternative embodiments, transformer 58A and capacitor 60A may be adjustable, such that capacitance C of capacitor 60A and the inductance L of secondary winding 53A may be adjusted to provide the characteristics described above.

When the preheat period of block 540 is complete, tube 54A enters ignition phase 545. In block 550, controller 64 causes AC signal generator 63A to once again decrease the frequency of primary AC signal 67A. As the frequency of low voltage primary AC signal 67A decreases in block 550, the frequency of high voltage secondary AC signal 71A also decreases and LCR circuit 80 approaches its resonance frequency. This decrease in frequency causes the magnetic field built up in transformer coil 58A to collapse relatively rapidly and the voltage across capacitor 60A to increase relatively rapidly. As secondary AC signal 71A in LCR circuit 80 approaches its resonance frequency, a point is reached in block 560, where the voltage drop across capacitor 60A is sufficiently high to ignite an arc through tube 54A (i.e. between filament 66 and filament 68). The frequency of low voltage AC signal 67A at which ignition occurs may be in the range of 1–10 kHz above the resonance frequency of LCR circuit 80, which may be 40–60 kHz, for example. During ignition in block 560, the typical voltage across tube 54A (i.e. between filament 66 and filament 68) may be in a range between 650–2500 V peak to peak. In general, the minimum required ignition voltage for tube 54A determines design limitations on the capacitance C of capacitor 60A and the inductance L of secondary winding 53A of transformer 58A.

When ignition occurs in block 560, the gas (not shown) in tube 54A is ionized, current flows and photons are produced as discussed above and as is well known in the art of fluorescent lighting. Once ignition of tube 54A has occurred, the current path through tube 54A (i.e. between filament 66 and filament 68) has a very low resistance. As such, a majority of the current of high voltage secondary AC signal 71A travels through filament 66, tube 54A and filament 68. A correspondingly little amount of current travels on the current path through capacitor 60A.

After ignition, controller 64 continues to reduce the frequency of primary AC signal 67A in block 570, as tube 54A transitions from ignition phase 545 into burn phase 565. During burn phase 565, the frequency of low voltage primary AC signal 67A may be in the range of 35–60 kHz. The decrease in frequency of primary AC signal 67A between the ignition frequency and the burn frequency may take approximately 10–20 ms, for example.

Once the frequency has been decreased in block 570, controller 64 may attempt to optimize the light produced by tube 54A and the power consumed by tube 54A in block 580. Signal sensor 70A detects one or more characteristics associated with low voltage primary AC signal 67A and provides this measured information to controller 64 as a part of signal information 72A. As mentioned above, signal information 72A may include information about the average value, RMS value, amplitude, waveform shape, frequency and/or duty cycle of the voltage and/or current of primary AC signal 67A. In alternative embodiments, signal sensor 70A is located in light 50 and connected to sense one or more characteristics of secondary high voltage AC signal 71A on secondary winding 53A of transformer 58A. Controller 64 then uses signal information 72A to produce control signal 65A, which is provided to signal generator 63A. Control signal 65A may cause signal generator 63A to adjust various characteristics of low voltage primary AC signal 67A, such as, for example, the average value, RMS value, amplitude, waveform shape, frequency and/or duty cycle of voltage and/or current of signal 67A.

Throughout block 580 of burn phase 565, control system 52 may continue to monitor and control low voltage primary AC signal 67A in real time and in the manner discussed above. Preferably, the object of controlling primary AC signal 67A is to optimize the light produced, efficiency and/or power consumed by tube 54A. In block 580, controller 64 may also make use of feedback information from other sensors (not shown) to provide information useful for controlling the light, efficiency and/or power consumed by tube 54A. Such sensors may include light sensors, temperature sensors and/or power sensors for example. Variations in operating conditions can affect the operation of tube 54A and control system 52. Variable operating conditions may include, for example, variances in temperature, fluctuations in DC output signal 66A from DC power supply 62, degradation of tube 54A, which may be caused by emitter breakdown, mercury pressure variations, pressure changes of the gas within tube 54A, and the like. Control system 52 attempts to compensate for these variances over the duration of burn phase 565 of tube 54A. Feedback-based control techniques are well known in the art and are not discussed further herein.

An advantage of control system 52 and light 50 is that the total operational frequency range is preferably in a range between 35–100 kHz. This range of frequencies is in the portion of the RF/EMI spectrum allocated for unlicensed, unlimited power radiation levels.

As discussed above, fluorescent light 50 may comprise a plurality of fluorescent tubes 54A, 54B . . . 54n. Fluorescent tubes 54A, 54B . . . 54n may have different sizes, shapes, intensities and/or operating characteristics. Controller 64 preferably operates sufficiently fast that it can control the operation of all of tubes 54A, 54B . . . 54n in real time. For example, controller 64 may make use of time division multiplexing techniques. Time division multiplexing is well known in the art and is not discussed further herein.

Control system 52 may also have other capabilities. For example, control system 52 may have a safety feature wherein signal sensors 70A, 70B . . . 70n are capable of detecting if one of the filaments in a tube 54A, 54B . . . 54n is broken or if one of tubes 54A, 54B . . . 54n has been removed or unplugged. Using this information, controller 64 may ensure that no signal is provided to the low voltage AC link 56A, 56B . . . 56n that is associated with the damaged or removed tube.

Control system 52 may also monitor the characteristics of individual fluorescent tubes 54A, 54B . . . 54n over time. For example, control system 52 may individually monitor changes of ignition frequency, ignition current, burn frequency, burn current, power consumption, etc. of particular tubes 54A, 54B . . . 54n over time. Such monitoring of tube characteristics may allow control system 52 to predict the end of the useful life of a tube. Control system 52 may provide diagnostic information including such tube characteristics to users over a suitable user interface (not shown). Such a user interface may be embodied in a wide variety of forms known to those skilled in the art. By way of non-limiting example, a user interface may include a suitably programmed computer, a visual interface, one or more LED's, a keypad input device and/or an ability to cause one or more of the fluorescent tubes 54A, 54B . . . 54n to blink.

Because of its ability to independently monitor and control the current through individual tubes 54A, 54B . . . 54n, control system 52 may permit additional "intelligent" functions, such as dimming and/or flashing of individual tubes 54A, 54B . . . 54n and sequencing or pattern generation using individual tubes 54A, 54B . . . 54n.

Figure 4:
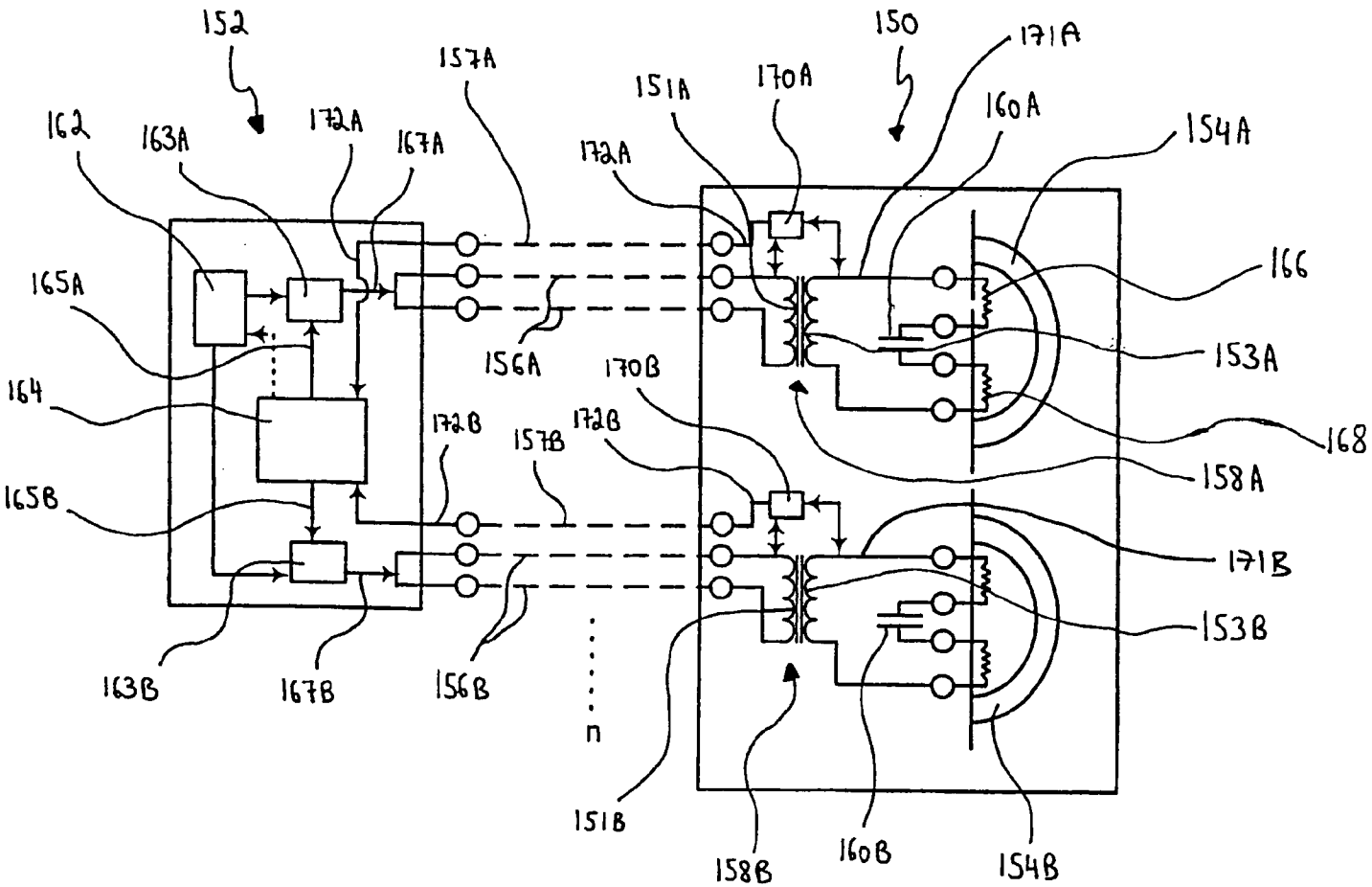
FIG. 4 is a schematic diagram of a fluorescent light, together with a light controller according to an alternative embodiment of the invention.

FIG. 4 schematically depicts a multi-tube fluorescent light 150, which comprises a distributed lighting control system 152 according to an alternative embodiment of the invention. Light 150 comprises a plurality of fluorescent tubes 154. Although only two such tubes 154A, 154B are shown in the illustrated embodiment, light 150 may generally comprise any practical number of fluorescent tubes 154. Light 150 and distributed lighting control system 152 of FIG. 4 are similar to light 50 and control system 52 of FIG. 2. Features of light 150 and control system 152 that are similar to features of light 50 and control system 52 are provided with similar reference numerals preceded by the digit "1". Features of light 150 and control system 152 that are substantially the same as features of light 50 and control system 52 are not discussed further in this description.

The principal differences between light 150 of FIG. 4 and light 50 of FIG. 2, are that signal sensors 170A, 170B are located within (or in close proximity to) light 150 and light 150 comprises extra communications links 157A, 157B, which provide for communication between signal sensors 170A, 170B and control system 152. Signal sensors 170A, 170B may detect signal information 172A, 172B related low voltage primary AC signals 167A, 167B in the primary windings 151A, 151B and/or high voltage secondary AC signals 171A, 171B in the secondary windings 153A, 153B of their associated transformers 158A, 158B. Signal information 172A, 172B may include information about the average value, RMS value, amplitude, waveform shape, frequency and/or duty cycle of the voltage and/or current of low voltage primary AC signals 167A, 167B and/or high voltage secondary AC signals 171A, 171B.

In the FIG. 4 embodiment, each signal sensor 170A, 170B communicates signal information 172A, 172B back to controller 164 via an associated communications link 157A, 157B. Communications links 157A, 157B are low power links and may be wireless connections. Control system 152 and each tube 154A, 154B may also comprise a small amount of suitably configured communications hardware (not shown) associated with communications links 157A, 157B.

Locating signal sensors 170A, 170B within (or in close proximity to) light 150 provides the possible advantage that the signal information 172A, 172B sensed may relate directly to high voltage secondary AC signals 171A, 171B and may therefore more closely approximate the actual signals through the terminals of tubes 154A, 154B. Consequently, signal information 172A, 172B may be independent of low voltage AC links 156A, 156B and transformers 158A, 158B. Such measurement may provide controller 164 with more accurate information about the actual current flow through the terminals of tubes 154A, 154B.

In other respects, light 150 and control system 152 comprise substantially the same components as light 50 and control system 52, which function in a manner that is substantially similar to that described above. The characteristics of low voltage primary AC signals 167A, 167B may be controlled to individually preheat, ignite and burn each of tubes 154A, 154B in a manner similar to that described above for light 50 and control system 52. Light 150 and control system 152 retain the important safety advantage that all electrical connections between control system 152 and light 150 are low voltage AC connections and low power communications connections, which improves the safety of light 150.

Figure 5:
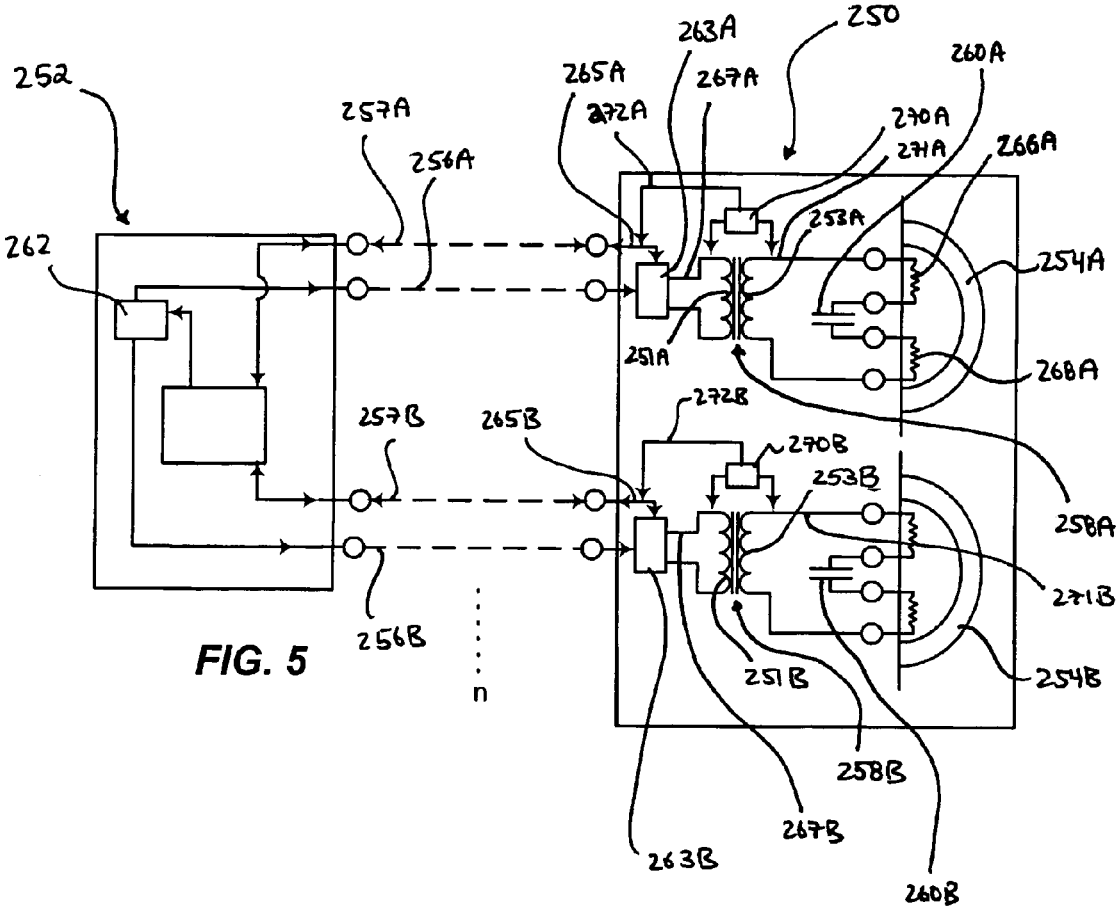
FIG. 5 is a schematic diagram of a fluorescent light together with a light controller according to another alternative embodiment of the invention.

FIG. 5 is a schematic diagram of a fluorescent light 250 together with its light controller 252 according to another alternative embodiment of the invention. Light 250 comprises a plurality of fluorescent tubes 254. Although only two such tubes 254A, 254B are shown in the illustrated embodiment, light 250 may generally comprise any practical number of fluorescent tubes 254. Light 250 and distributed lighting control system 252 of FIG. 6 are similar to light 50 and control system 52 of FIG. 1. Features of light 250 and control system 252 that are substantially similar to features of light 50 and control system 52 are provided with similar reference numerals preceded by the digit "2". Features of light 250 and control system 252 that are substantially the same as features of light 50 and control system 52 are not discussed further in this description.

Figure 1:
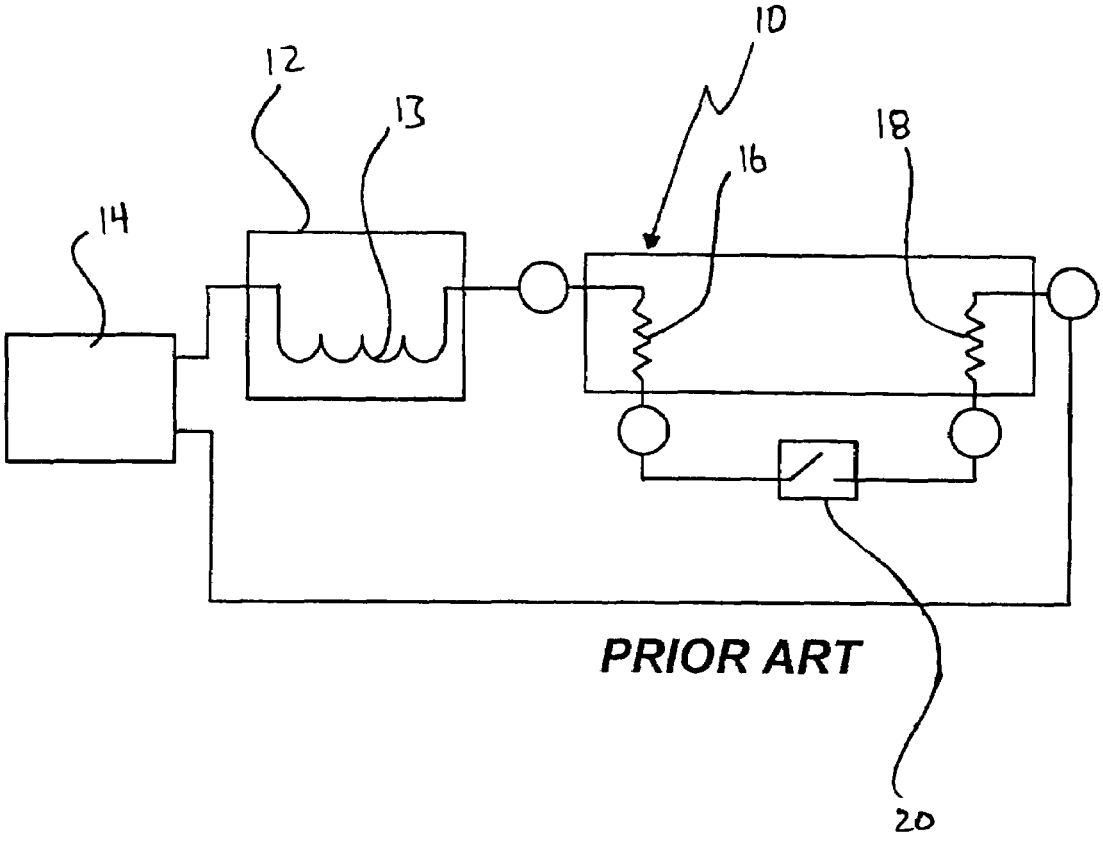
FIG. 1 is a schematic diagram of a prior art fluorescent tube.

The principal difference between light 250 and light control system 252 of FIG. 5 and light 50 and light control system 52 of FIG. 1, is that both signal sensors 270A, 270B and AC signal generators 263A, 263B are located within (or in close proximity to) light 250. Controller 264 provides control signals 265A, 265B to AC signal generators 263A, 263B over communication links 257A, 257B and signal sensors 270A, 270B use the same communication links 257A, 257B to provide signal information 272A, 272B to controller 264. DC power supply 262 provides low voltage DC power to AC signal generators 263A, 263B via low voltage DC links 256A, 256B.

Locating sensors 270A, 270B within (or in close proximity to) light 250 allows sensors 270A, 270B to detect signal information 272A, 272B relating to primary AC signals 267A, 267B in the primary windings 251A, 251B and/or secondary AC signals 271A, 271B in the secondary windings 253A, 253B of their associated transformers 258A, 258B. Signal information 272A, 272B detected by sensors 270A, 270B may include information about the average value, RMS value, amplitude, waveform shape, frequency and/or duty cycle of the voltage and/or current of primary AC signals 267A, 267B and/or secondary AC signals 271A, 271B.

Communications links 257A, 257B are low power two-way communication links and may be wireless connections. Control system 252 and each tube 254A, 254B may also comprise a small amount of suitably configured communications hardware (not shown) associated with communications links 257A, 257B.

Locating signal sensors 270A, 270B within (or in close proximity to) light 250 provides the same advantages discussed above in relation to light 150 and control system 152 of FIG. 4. In other respects, light 250 and control system 252 comprise the same components and function in a manner that is substantially similar to light 50 and control system 52 described above. The characteristics of primary AC signals 267A, 267B may be controlled to individually preheat, ignite and burn each of tubes 254A, 254B in a manner similar to that described above for light 50 and control system 52. Light 250 and control system 252 still retain the important safety advantage that all electrical connections between control system 252 and light 250 are low voltage DC connections and low powered communications connections, which improves the safety of light 250.

As will be apparent to those skilled in the art in the light of the foregoing disclosure, many alterations and modifications are possible in the practice of this invention without departing from the spirit or scope thereof. For example:

The embodiments described above comprise signal sensors, which sense signal information at various locations in the light or in the control system. Lights and/or control systems in accordance with the invention may include additional signal sensors. In some embodiments, signal sensors are provided in the light and in the control system. In addition, other types of sensors may be provided to sense other characteristics of the tubes within a light and feedback this information to the control system. For example, the control systems and lights described above could comprise power sensors, illumination sensors, temperature sensors and the like. Such sensors could provide additional information useful for feedback based control of fluorescent tubes.

In the embodiments described above, each fluorescent tube includes a transformer, which directly powers the tube. Other driver or interface electronics may be provided to power the tube. For example, a high voltage switch mode driver and fluorescent tube interface electronics may receive signals from the control system and may provide an output signal to the fluorescent tube.

Some of the embodiments described above include communications links associated with each tube. Those skilled in the art will appreciate that communication between each tube and the control system may be embodied with a single physical or wireless communications link and that information sent and/or received to/from each tube may be multiplexed on such a link.

While the embodiment of FIG. 5 is depicted and described as having a low voltage DC link 256A, 256B associated with each of its fluorescent tubes 254A, 254B and their corresponding AC signal generators 263A, 263B, those skilled in the art will appreciate that only a single low voltage DC signal is required and such a low voltage DC signal is capable of powering a plurality of AC signal generators (e.g. AC signal generators 263A, 263B) or a single, multiple output AC signal generator (not shown). Accordingly, the FIG. 5 embodiment only requires a single low voltage DC link 256 between control system 252 and light 250.

All of the embodiments described above include a coupling capacitor between the filaments of the tube. For example, tube 54A of light 50 comprises capacitor 60A between two terminals of filaments 66, 68 (see FIG. 2). Capacitor 60A could be replaced with any suitably selected coupling device, capable of allowing current to pass during a preheat phase and then creating a large voltage drop during ignition and burn phases. Suitable coupling devices may include: a positive temperature coefficient thermistor, a bi-metallic switch, a bimetallic gas discharge switch, a controllable switching element or a resonant piezoelectric switch, for example. The switching action of the coupling device may be controlled by the controller.

What is claimed is:

1. A system for controlling a light having a plurality of fluorescent tubes, each fluorescent tube having a pair of filaments, the system comprising:

a plurality of transformers located in the light, each transformer having a primary winding and a secondary winding coupled between the filaments of a corresponding one of the fluorescent tubes at first terminals thereof;

a plurality of sensors, each sensor connected to detect signal information indicative of a signal between the filaments of a corresponding one of the fluorescent tubes;

one or more AC signal generators located remotely from the light, the one or more AC signal generators capable of generating a plurality of low voltage AC signals, each low voltage AC signal associated with a corresponding one of the fluorescent tubes;

a plurality of low voltage AC links, each low voltage AC link connected to conduct a corresponding low voltage AC signal between the one or more AC signal generators and the primary winding of a corresponding transformer of a corresponding one of the fluorescent tubes; and a controller located remotely from the light, the controller connected to receive signal information from the plurality of sensors and the controller configured, on the basis of the signal information, to independently control one or more characteristics of each of the low voltage AC signals.

2. A system according to claim 1 comprising a plurality of coupling devices located in the light, each coupling device associated with a corresponding one of the fluorescent tubes, each coupling device coupled between the filaments of the corresponding fluorescent tube at second terminals thereof and each coupling device changeable between a conducting state, wherein the coupling device is capable of conducting sufficient current to prevent arcing between the filaments of the corresponding fluorescent tube, and a non-conducting state wherein a voltage drop across the coupling device is sufficient to cause current to arc between the filaments of the corresponding fluorescent tube.

3. A system according to claim 2 wherein each coupling device comprises a capacitor and wherein the secondary winding of a corresponding transformer, the capacitor and the filaments of the corresponding fluorescent tube form a corresponding LCR resonant circuit.

4. A system according to claim 3 wherein the one or more characteristics of each low voltage AC signal comprises a frequency of the low voltage AC signal.

5. A system according to claim 4 wherein the controller is configured to independently light a particular fluorescent tube by controlling the frequency of its associated low voltage AC signal to be a relatively low frequency during an ignition phase and a relatively high frequency during an ignition phase.

6. A system according to claim 5 wherein the relatively high frequency is in a range of 60–100 kHz.

7. A system according to claim 6 wherein the relatively low frequency is in a range of 40–60 kHz.

8. A system according to claim 5 wherein the coupling device corresponding to the particular one of the fluorescent tubes is in its conducting state during the preheat phase and changes to its non-conducting state during the ignition phase.

9. A system according to claim 8 wherein the coupling device associated with the particular fluorescent tube changes from its conducting state to its non-conducting state when the frequency of the low voltage AC signal associated with the particular fluorescent tube is in a range of 10 kHz from a resonant frequency of the corresponding LCR circuit.

10. A system according to claim 7 wherein, after the ignition phase of the particular fluorescent tube, the controller is configured to control the frequency of the low voltage AC signal associated with the particular fluorescent tube to be a burn frequency lower than the relatively low frequency during a burn phase.

11. A system according to claim 10 wherein the burn frequency is in a range of 40–60 kHz.

12. A system according to claim 1 wherein each signal sensor is connected to sense signal information relating to the low voltage signal associated with the corresponding fluorescent tube at a location remote from the light.

13. A system according to claim 12 wherein, for each signal sensor, the controller is configured, based on the signal information relating to the low voltage signal associated with the corresponding fluorescent tube at the location remote from the light, to estimate signal information related to the signal between the filaments of the corresponding fluorescent tube.

14. A system according to claim 12 wherein the only electrical connections necessary to independently control operation of the plurality of fluorescent tubes are the plurality of low voltage AC links.

15. A system according to claim 12 wherein each signal sensor is located in the light and is connected to sense signal information relating to a secondary AC signal in the secondary winding of the corresponding transformer.

16. A system according to claim 15 wherein, for each signal sensor, the controller is configured, based on the signal information relating to the secondary AC signal in the secondary winding of the corresponding transformer, to estimate signal information related to the signal between the filaments of the corresponding fluorescent tube.

17. A system according to claim 12 wherein the only connections necessary to independently control operation of the plurality of fluorescent tubes are the plurality of low voltage AC links and a communication link for providing signal information from the sensors to the controller.

18. A system according to claim 2 wherein each coupling device comprises one or more of: a positive temperature coefficient thermistor; a bimetallic switch; a bi-metallic gas discharge switch; a controllable switching element; and a resonant piezoelectric switch.

19. A system according to claim 18 wherein the controller is connected to control changing of each coupling device between its conducting state and its non-conducting state.

20. A system according to claim 1 wherein the controller is configured to independently control operation of the plurality of fluorescent tubes using time division multiplexing.

21. A system for controlling a light having a plurality of fluorescent tubes, each fluorescent tube having a pair of filaments, the system comprising:

a plurality of transformers located in the light, each transformer having a primary winding and a secondary winding coupled between the filaments of a corresponding one of the fluorescent tubes at first terminals thereof;

a plurality of sensors located in the light, each sensor connected to detect signal information related to a signal between the filaments of a corresponding one of the fluorescent tubes;

one or more AC signal generators located in the light, the one or more AC signal generators capable of generating a plurality of low voltage AC signals and driving a corresponding one of the low voltage AC signals onto the primary winding of a corresponding transformer of a corresponding one of the fluorescent tubes;

a low voltage DC link for providing a low voltage DC signal to the one or more AC signal generators; and a controller located remotely from the light, the controller connected to receive signal information from the plurality of sensors over a communication link and the controller configured, on the basis of the signal information, to generate control signals and to communicate the control signals to the one or more AC signal generators over the communications link to independently control one or more characteristics of each of the low voltage AC signals.

22. A method for controlling a light having a plurality of fluorescent tubes, each fluorescent tube having a pair of filaments, the method comprising:

providing a plurality of transformers located in the light, each transformer having a primary winding and a secondary winding coupled between the filaments of a corresponding one of the fluorescent tubes at first terminals thereof;

providing a plurality of capacitors located in the light, each capacitor coupled between the filaments of a corresponding one of the fluorescent tubes at second terminals thereof, the secondary winding, the capacitor and the filaments of each fluorescent tube forming an LCR resonant circuit;

generating a plurality of low voltage AC signals having a relatively high frequency at a location remote from the light, conducting the plurality of low voltage AC signals to the light over a corresponding plurality of low voltage AC links and applying each low voltage AC signal to the primary winding of a corresponding transformer of a corresponding one of the fluorescent tubes; and decreasing a frequency of the plurality of low voltage AC signals until resonance in the corresponding LCR circuits causes the corresponding fluorescent tubes to ignite.

23. A method according to claim 21 wherein the relatively high frequency is in a range of 60–100 kHz.

24. A method according to claim 20 wherein decreasing a frequency of the plurality of low voltage AC signals until resonance in the corresponding LCR circuits causes the corresponding fluorescent tubes to ignite comprises decreasing the frequency of the plurality of low voltage AC signals to a frequency that is within 10 kHz of a resonant frequency of the corresponding LCR circuits.

* * * * *